US009921547B2

(12) United States Patent
Cusin et al.

(10) Patent No.: US 9,921,547 B2
(45) Date of Patent: Mar. 20, 2018

(54) OSCILLATOR WITH ROTATING DETENT

(71) Applicant: Nivarox-FAR S.A., Le Locle (CH)

(72) Inventors: Pierre Cusin, Villars-Burquin (CH); Romain Le Moal, Besancon (FR)

(73) Assignee: Nivarox-FAR S.A., Le Locle (CH)

( * ) Notice: Subject to any disclaimer, the term of this patent is extended or adjusted under 35 U.S.C. 154(b) by 40 days.

(21) Appl. No.: 15/228,684

(22) Filed: Aug. 4, 2016

(65) Prior Publication Data

US 2017/0090422 A1 Mar. 30, 2017

(30) Foreign Application Priority Data

Sep. 28, 2015 (EP) ..... 15187214

(51) Int. Cl.
*G04B 17/02* (2006.01)
*G04B 17/28* (2006.01)
(Continued)

(52) U.S. Cl.
CPC ..... *G04B 17/285* (2013.01); *G04B 15/00* (2013.01); *G04B 15/08* (2013.01); *G04B 15/14* (2013.01); *G04B 17/02* (2013.01)

(58) Field of Classification Search
CPC ..... G04B 15/00; G04B 15/02; G04B 15/04; G04B 15/14; G04B 17/02; G04B 17/285
See application file for complete search history.

(56) References Cited

U.S. PATENT DOCUMENTS 1,860,260 A * 5/1932 Marti ..... G04B 15/06 368/124
1,895,666 A * 1/1933 Helmut Junghans .. G04B 15/08 368/124
(Continued)

FOREIGN PATENT DOCUMENTS

CH 159710 A * 1/1933 ..... G04B 15/02
DE 102015015211 A1 * 5/2017 ..... G04B 15/00
(Continued)

OTHER PUBLICATIONS

European Search Report dated May 31, 2016 in European application 15187214.0, filed on Sep. 28, 2015 ( with English Translation of Categories of Cited Documents).
(Continued)

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

The invention relates to an oscillator comprising a pivoting staff connected to a mechanical energy source, an inertia-elasticity resonator formed in one piece, which is mounted on the pivoting staff, a detent escapement comprising a single-piece detent fixed to the pivoting staff, which comprises at least one flexible blade and a stop member arranged to elastically lock the pivoting staff in relation to a concentric escapement toothing, wherein the release element is arranged to elastically unlock the stop member in relation to the concentric escapement toothing, by the movement of the member forming the inertia, so that the pivoting staff counts each oscillation of the resonator while transmitting to it the energy able to maintain it.

14 Claims, 6 Drawing Sheets

(51) Int. Cl.

| | |
|---|---|
| ***G04B 15/00*** | (2006.01) |
| ***G04B 15/14*** | (2006.01) |
| ***G04B 15/08*** | (2006.01) |

(56) References Cited

U.S. PATENT DOCUMENTS

| | | | | |
|---|---|---|---|---|
| 2013/0176829 | A1 | 7/2013 | Cusin et al. | |
| 2014/0307530 | A1 | 10/2014 | Beugin et al. | |
| 2015/0234354 | A1* | 8/2015 | Henein | G04B 17/045 368/170 |
| 2016/0246257 | A1* | 8/2016 | Cusin | G04B 17/04 |
| 2017/0227930 | A1* | 8/2017 | Di Domenico | G04B 17/04 |
| 2017/0269551 | A1* | 9/2017 | Semon | G04B 15/02 |

FOREIGN PATENT DOCUMENTS

| | | | | |
|---|---|---|---|---|
| EP | 2498141 | A2 * | 9/2012 | G04B 19/241 |
| EP | 2 790 067 | A1 | 10/2014 | |
| EP | 2 894 520 | A2 | 7/2015 | |
| EP | 3001257 | A1 * | 3/2016 | G04B 17/04 |
| GB | 736751 | A * | 9/1955 | F42C 9/04 |

OTHER PUBLICATIONS

Denis Schnegg "Le Chronometer Tourbillon a Echappement Détente Sous Trois Ponts D'Or Reedition 1982" Congres International De Chronometrie. Besancon, Soc. Fr. Microtec. Et Chronom, Fr, vol. 2, XP002101229, Oct. 4, 1984, 5 Pages.

* cited by examiner

OSCILLATOR WITH ROTATING DETENT

This application claims priority from European Patent application 15187214.0 of Sep. 28, 2015, the entire disclosure of which is hereby incorporated herein by reference.

FIELD OF THE INVENTION

The invention relates to a tourbillon-type oscillator comprising an inertia-elasticity resonator cooperating with a rotating detent escapement.

BACKGROUND OF THE INVENTION

Detent escapement systems are known to have brought high precision to marine chronometers in the 18th century by providing a direct impulse and a low sensitivity to friction. However, they have proved to be particularly difficult to adjust and sensitive to shocks. Some marine chronometers have thus been assembled in vacuum, in sand or even on gimbals to prevent the transmission of any shocks that cause tripping, i.e. the accidental passage of two teeth of the escape wheel instead of one that can disturb the working of the timepiece. Hence, considering the sensitivity to shocks and the space requirement of such assemblies, it is currently inconceivable to use a reliable detent escapement system in a wristwatch.

SUMMARY OF THE INVENTION

The aim of the present invention is to overcome all or some of the abovementioned disadvantages by proposing an oscillator comprising an inertia-elasticity resonator that cooperates with a new type of detent escapement that is free from tripping and its operation leads to advantages usually associated with much more complex tourbillon-type oscillators.

Hence, the invention relates to an oscillator comprising a pivoting staff connected to a mechanical energy source, an inertia-elasticity resonator formed in one piece comprising a member forming said inertia fitted with a release element and a flexible structure forming said elasticity, which is mounted between the pivoting staff and the member forming the inertia, a detent escapement comprising a single-piece detent fixed to the pivoting staff, which comprises at least one flexible blade and a stop member arranged to elastically lock the pivoting staff in relation to a concentric escapement toothing, wherein the release element is arranged to elastically unlock the stop member in relation to the concentric escapement toothing by the movement of the member forming the inertia, so that the pivoting staff counts each oscillation of the resonator while transmitting to it the energy able to maintain it.

Advantageously according to the invention, it is thus understood that the oscillator comprises very few parts to be assembled, since the majority of them are formed in a single piece, which enables the parts to be referenced more easily in relation to one another. Moreover, because of the use of flexible structures, also called monolithic articulated structures or flexible bearings, the resonator has a very low thickness and inherently causes tripping to be eliminated. Moreover, the oscillator according to the invention advantageously allows the resonator to have an impulse by a direct torque rather than a force by contact, as in the case of a usual detent escapement. In fact, by rotating the pivoting staff eliminates working variations of the oscillator in vertical positions.

In accordance with other advantageous variants of the invention:

- the flexible structure comprises at least one anchoring device fixed to the pivoting staff and flexible devices arranged to form a virtual pivot axis of the resonator coincident with the centre of rotation of the pivoting staff;
- the flexible devices comprise at least one base respectively connecting the member forming the inertia and the at least one anchoring device by at least one flexible blade;
- the member forming the inertia is formed by two sectors, wherein the inside surface of one of the sectors comprises the release element;
- the release element comprises a flexible body, the free end of which is fitted with a discharging pallet, the displacement of which controlled by the member forming the inertia is arranged to come into contact with the single-piece detent at each vibration of the resonator;
- the release element additionally comprises a releasing stop arranged to force the flexible body to displace the single-piece detent in a single direction of the oscillations of the resonator;
- according to a first variant, the single-piece detent comprises a single flexible blade, a detent stop being fixed to the single flexible blade and arranged to come into contact with the release element on each vibration of the resonator;
- according to a second variant, the single-piece detent comprises two parallel cross members, wherein a first cross member is connected at a first end to the pivoting staff, and at a second end perpendicularly to a first flexible blade, and a second cross member is connected at a first end to the stop member and at a second end perpendicularly to a second flexible blade, wherein the first and second flexible blades are parallel and respectively connected to the second and first cross members;
- according to a third variant, the single-piece detent comprises two parallel cross members, wherein a first cross member is connected at a first end to the pivoting staff, and perpendicularly to a first flexible blade, and a second cross member is connected at a first end to the stop member and at a second end perpendicularly to a second flexible blade, wherein the first and second flexible blades are parallel and respectively connected to the second and first cross members;
- according to the second and third variants, the single-piece detent comprises a detent stop fixed to the second cross member, which is arranged to come into contact with the release element on each vibration of the resonator;
- according to a fourth variant the single-piece detent comprises first and second flexible and non-parallel blades, each connecting the pivoting staff to an attachment, wherein the attachment is additionally connected to a third flexible blade, the free end of which includes the stop member and to a fourth flexible blade comprising a detent stop, which is arranged to come into contact with the release element on each vibration of the resonator;
- the pivoting staff comprises a pinion arranged to mesh with a going train in order to be connected to the mechanical energy source and to display the time;
- the pinion is mounted to be idle on the pivoting staff by means of an elastic energy accumulator in order to supply sufficient energy to maintain the resonator during the impulse period;

the single-piece resonator and the single-piece detent are formed in two fixed single plates forming two functional levels of the pivot axis.

BRIEF DESCRIPTION OF THE DRAWINGS

Other features and advantages of the present invention will appear more clearly upon reading the following detailed description, made with reference to the annexed drawings, given by way of non-limiting and in with.

DETAILED DESCRIPTION OF THE PREFERRED EMBODIMENTS

The invention relates to an oscillator for a timepiece, i.e. a resonator coupled to a distribution and maintenance system such as an escapement system, for example.

Figure 1:
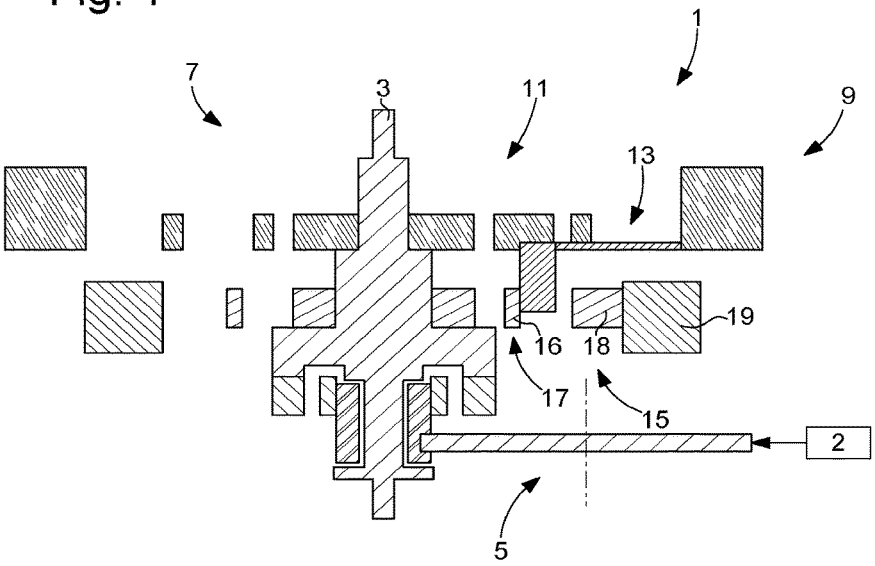
FIG. 1 is a schematic sectional view of an oscillator according to the invention.

As shown schematically in FIG. 1, the oscillator 1 according to the invention comprises a pivoting staff 3 connected to a mechanical energy source 2, for example, by means of a going train 5. Such an energy source 2 can comprise devices for accumulating energy by elastic deformation and/or pneumatic storage. As an example, the accumulation devices can take the form of a metal blade mounted in a pivoting drum to form a barrel. However, other types of mechanical energy source can also be envisaged.

The oscillator 1 according to the invention comprises a single-piece inertia-elasticity resonator 7. This resonator 7 preferably includes a member 9 forming said inertia and a flexible structure or flexible bearing 11 forming said elasticity. As shown schematically in FIG. 1, the flexible structure 11 is preferably formed in a single piece with the member 9 and is mounted between the pivoting staff 3 and the member 9. Finally, the member 9 forming the inertia is also fitted with a release element 13.

The amplitude of the resonator 7 is limited to the maximum clearances of the flexible structure 11, as will be explained more clearly in the following embodiments. This limitation of the clearances nevertheless renders tripping of the resonator 7 inherently impossible, which solves by construction the main problem that customarily puts detent escapement systems at a disadvantage.

As shown schematically in FIG. 1, the oscillator 1 additionally comprises a detent escapement 15 comprising a single-piece detent 17 also fixed to the pivoting staff 3. The detent 17 comprises at least one flexible blade 16 and a stop member 18 arranged to elastically lock the pivoting staff 3 in relation to a concentric escapement toothing in relation to the pivoting staff 3.

As will be explained more clearly in the following embodiments, the release element 13 is arranged to elastically unlock the stop member 18 in relation to the fixed concentric escapement toothing 19, by the movement of the inertia member 9, so that the pivoting staff 3 counts each oscillation of the resonator 7 while transmitting to it the energy capable of maintaining it.

Advantageously according to the invention, it is thus understood that the oscillator 1 comprises very few parts to be assembled, since the majority of them are formed in a single piece, and this allows the parts to be referenced more easily in relation to one another. Moreover, because of the use of the flexible structure, the resonator 7 has a very low thickness and inherently causes the elimination of tripping. Moreover, the oscillator 1 according to the invention advantageously allows the resonator 7 to have an impulse by a direct torque rather than a contact force, as in the case with a usual detent escapement. In fact, by rotating the pivoting staff eliminates working variations of the oscillator 1 in vertical positions.

Figure 2:
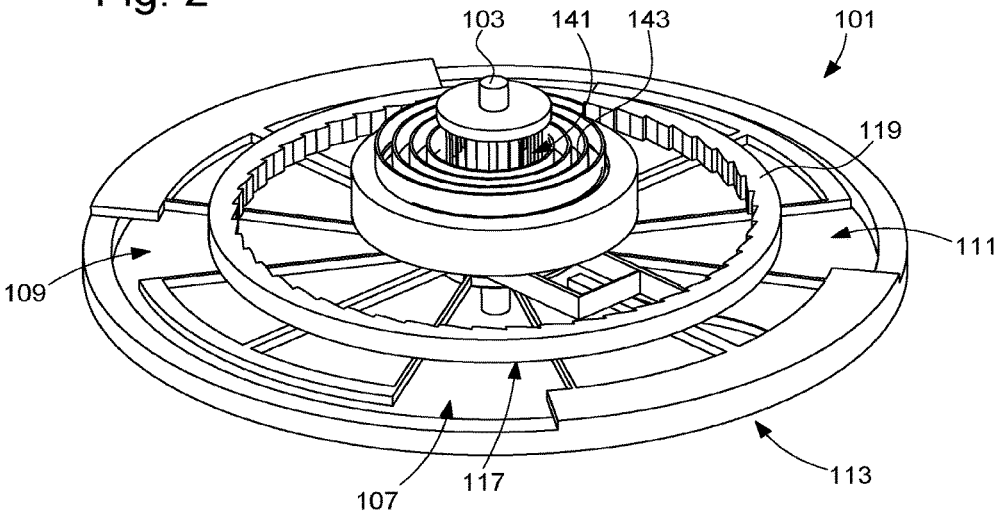
FIG. 2 is a perspective view of a first embodiment of an oscillator according to the invention.
Figure 3:
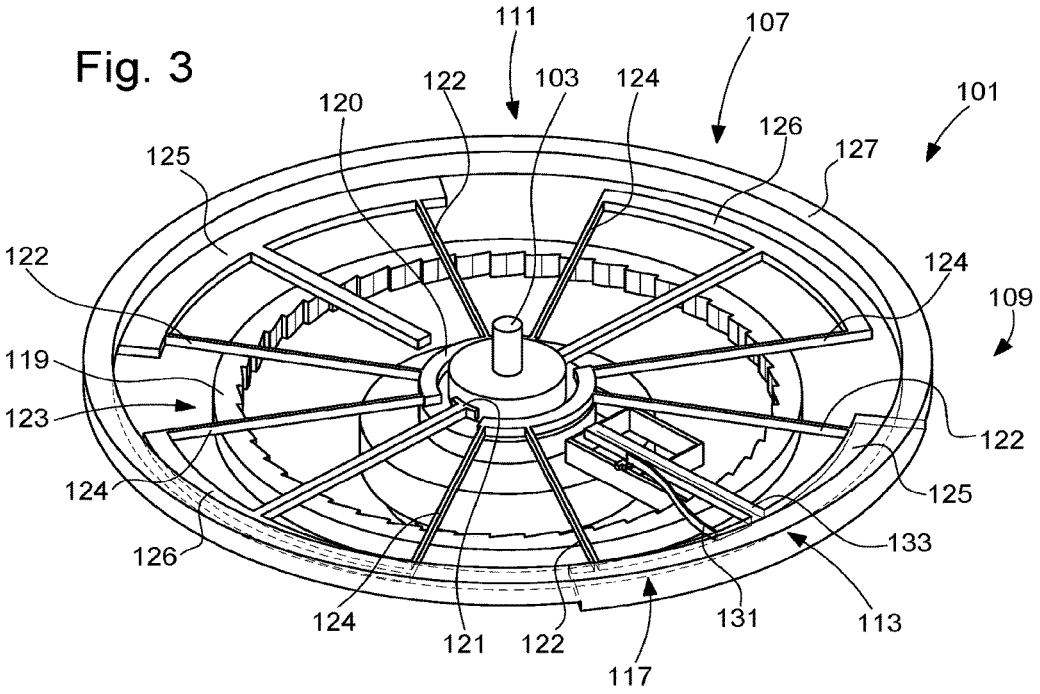
FIG. 3 is an inverted view of FIG. 2.
Figure 4:
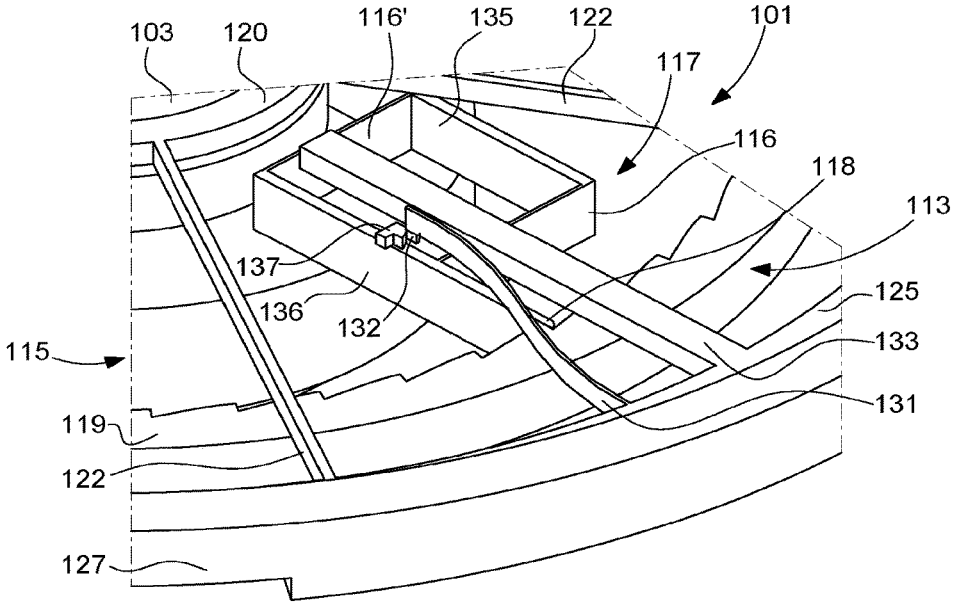
FIG. 4 is an enlarged view of FIG. 3.

All these advantages will be better understood considering a first embodiment of an oscillator 101 according to the invention in relation to FIGS. 2 to 4. Thus, the oscillator 101 comprises a pivoting staff 103 connected to a mechanical energy source (not shown) and a single-piece inertia-elasticity resonator 107.

This resonator 107 comprises a member 109 forming the inertia and a flexible structure 111 forming the elasticity. The flexible structure 111 is formed in a single piece with the member 109 and is mounted between the pivoting staff 103 and the member 109. As illustrated in FIG. 3, the flexible structure 111 comprises at least one anchoring device 121 fixed to the pivoting staff 103 and flexible devices 123 arranged to form a virtual pivot axis of the resonator 107 coincident with the centre of rotation of the pivoting staff 103.

More specifically, the flexible devices 123 comprise at least one base 120 respectively connecting the inertia member 109 and the at least one anchoring device 121 by at least one flexible blade 122, 124. As illustrated in FIG. 3, the inertia member 109 is preferably formed by two sectors 125 connected to one another by a ring 127 to obtain a single-piece inertia member 109.

Moreover, as evident from FIG. 3, each of the sectors 125 is formed in a single piece with flexible devices 123. More precisely, each sector 125 forming the inertia is connected by two flexible blades 122 to the partially annular base 120, which is fixed to two other flexible blades 124 with two anchoring devices 121 respectively by means of a substantially T-shaped beam 126. It is observed that each beam 126 is thus fixed to an anchoring device 121 and the two sectors 125 forming the inertia.

It is understood that the amplitude of the resonator 107 is thus limited to the maximum clearances of the flexible structure 111, and in particular the geometry of the beams 126, the bases 120 and the blades 122, 124. This limitation of the clearances nevertheless renders tripping of the resonator 107 inherently impossible, which solves by construction the main problem that customarily puts detent escapement systems at a disadvantage.

As evident in FIGS. 3 and 4, the inertia member 109 is also fitted with a release element 113. More precisely, the inside surface of one of the sectors 125 comprises the release element 113. In the first embodiment the release element 113 comprises a flexible body 131, the free end of which is fitted with a discharging pallet 132, the displacement of which controlled by the inertia member 109 is arranged to come into contact with the single-piece detent 117 at each vibration of the resonator 107.

More specifically, in the manner of a usual detent escapement, the first embodiment comprises a release element 113 that allows, in one of the directions of oscillation, a mute vibration, i.e. the release element 113 comes into contact with the detent 117, but does not displace the detent 117. Thus, according to the first embodiment the release element 113 preferably additionally comprises a releasing stop 133 arranged to force the flexible body 131 to displace the single-piece detent 117 in a single direction of the oscillations of the resonator 107.

As illustrated more clearly in FIG. 4, the oscillator 101 additionally comprises a detent escapement 115 comprising a single-piece detent 117 fixed to the pivoting staff 103. The detent 117 comprising at least one flexible blade 116, 116' and a stop member 118 arranged to elastically lock the pivoting staff 103 in relation to a concentric escapement toothing 119 in relation to the pivoting staff 103.

It is thus understood that the toothing 119 is fixed in relation to the pivoting staff 103. In fact, under the force of the mechanical energy source, the pivoting staff 103 will perform a rotation at each oscillation of the resonator 107, which will correspond to the angle between two teeth of the escapement toothing 119, i.e. each time that the stop member 118 of the detent 117 will permit its displacement from one tooth to the other.

In the first embodiment illustrated in FIGS. 2 to 4, the single-piece detent 117 comprises two parallel cross members 135, 136 and two parallel blades 116, 116'. As seen more clearly from FIG. 4, a first cross member 135 is connected, at a first end, to the pivoting staff 103, and, at a second end, perpendicularly to a first flexible blade 116. Moreover, the second cross member 136 is connected, at a first end, to the stop member 118 and, at a second end, perpendicularly to a second flexible blade 116'. Finally, the first 116 and second 116' flexible blades are respectively connected to the second 136 and first 135 cross members.

It is thus understood that the cross members 135, 136 visible in resting position in FIGS. 3 and 4 are able to be displaced relatively in relation to one another by means of the elastic bending of the flexible blades 116, 116'. More precisely, the release element 113 is arranged to force the flexible blades 116, 116' to bend in order to elastically unlock the stop member 118 in relation to the concentric escapement toothing 119, by the movement of the inertia member 109, so that the pivoting staff 103 counts each oscillation of the resonator 107 while transmitting to it the energy able to maintain it.

This is made possible because the single-piece detent 117 comprises a detent stop 137 fixed to the second cross member 136, which is arranged to come into contact with the release element 113 at each vibration of the resonator 107. As evident from FIG. 4, the detent stop 137 forms a cam which, when it comes into contact with the discharging pallet 132, forces, by the action of the releasing stop 133, the cross member 136 to move away from the escapement toothing 119 to release the pivoting staff 103. The pivoting staff 103 under the force of the mechanical energy source will perform a rotation, which corresponds to the angle between two teeth of the escapement toothing 119 and at the same time relaunches the resonator 107 by the transmission of its movement directly by the beams 126 via the anchoring devices 121.

In contrast, in the reverse vibration of the resonator 107, it is observed that the detent stop 137 forms a cam which, when it comes into contact with the discharging pallet 132, by the lack of action of the releasing stop 133 in the reverse direction, forces the discharging pallet 132 to move elastically away, then once having escaped the detent stop 137, to come back elastically along the releasing stop 133.

Advantageously, according to the first embodiment of the invention it is thus understood that the oscillator 101 comprises very few parts to be assembled, since the majority of them are formed in a single piece, which enables the parts to be referenced more easily in relation to one another. In fact, by way of example, the single-piece resonator 107 and the single-piece detent 117 could be formed in two fixed single plates forming at least two functional levels of the pivot axis 103. This could be achieved, for example, by silicon plates that are fixed in place, then etched, or by electroforming a metal part at several levels.

Moreover, because of the use of the flexible structure 111, the resonator107 has a very low thickness and inherently causes tripping to be eliminated. Moreover, the oscillator 101 according to the invention advantageously allows the resonator 107 to have an impulse by a direct torque rather than a force by contact, as in the case of a usual detent escapement.

In addition, the operation leads to advantages usually associated with much more complex tourbillon-type oscillators. In fact, the tourbillon is a device conceived by A.-L. Breguet at the beginning of the 19th century to eliminate working variations in vertical positions. It comprises a movable frame, which carries all the elements of the escapement and with the regulator member in its centre. The escapement pinion rotates around the seconds wheel, which is fixed. The frame that makes one rotation per minute eliminates working variations in vertical positions by turning.

Consequently, in the manner of a tourbillon, but without its adjustment complexity, the pivoting staff 103 of the first embodiment eliminates the working variations of the oscillator 101 in vertical positions by turning the resonator 107 at the same time as the detent 117.

Finally, as illustrated in FIG. 2, the pivoting staff 103 additionally comprises a pinion 141 arranged to mesh with a going train in order to be connected to the mechanical energy source and to display the time. According to the first embodiment, the pinion 141 is preferably mounted to be idle on the pivoting staff 103 by means of an elastic energy accumulator 143 in order to supply sufficient energy to maintain the resonator 107 during the releasing period. In the example of FIG. 2 it may be seen that the elastic energy accumulator 143 is a spiral-shaped spring. However, the elastic energy accumulator does not have to be limited to a spiral-shaped spring. Hence, as an absolutely non-restrictive example, the assembly comprising the pivoting staff 103, elastic energy accumulator 143 and pinion 141 could alternatively be one of the embodiments of energy transmission motion works described in document EP 2 455 821 incorporated into the present description by reference.

On reading the first embodiment, it is thus understood that the assembly comprising the pivoting staff 103, elastic energy accumulator 143 and pinion 141 is not essential and could also be replaced by a pivoting staff 103 fitted with a peripheral toothing meshed with the going train. Whatever the choice of energy transmission, it is clear that the force of the going train, and possibly that of the elastic energy accumulator 143, must be dimensioned so as not to drive the operation of the detent 117 in any other way than by the release element 113.

Figure 5:
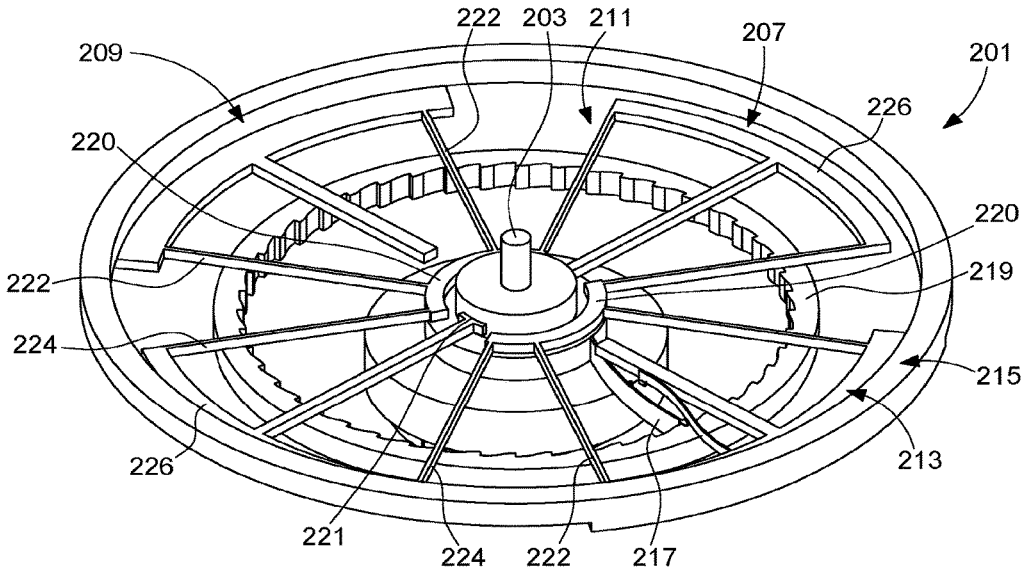
FIG. 5 is a perspective view of a second embodiment of an oscillator according to the invention.
Figure 6:
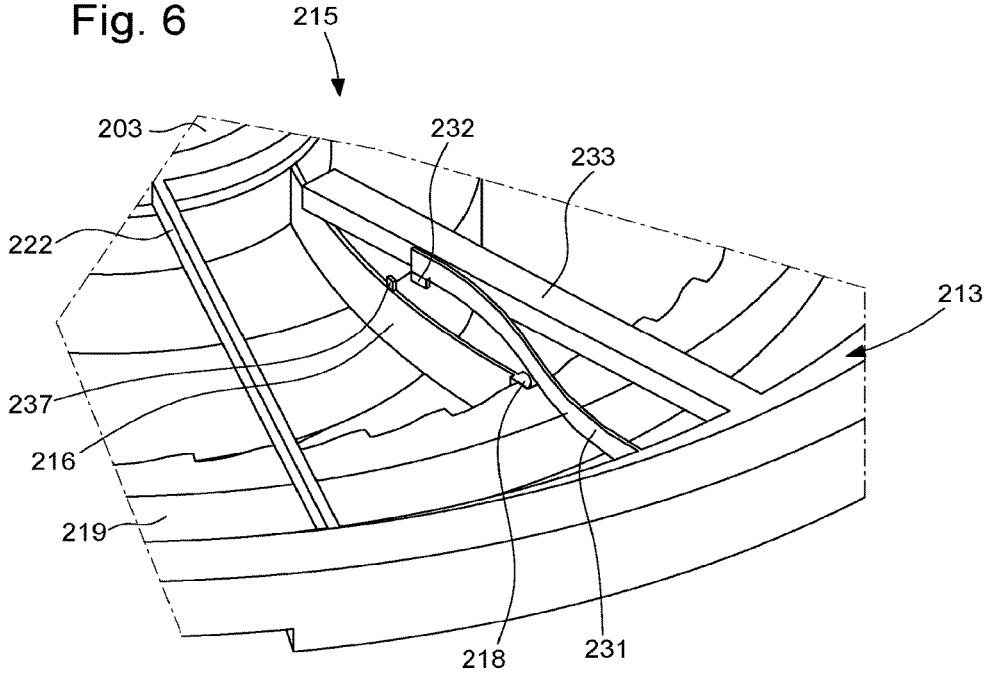
FIG. 6 is an enlarged view of FIG. 5.

A second embodiment of an oscillator 201 according to the invention is presented in FIGS. 5 and 6. Thus, the oscillator 201 comprises a pivoting staff 203 and a single-piece inertia-elasticity resonator 207 similar to those 103, 107 of the first embodiment. This resonator 207 thus includes a member 209 forming the inertia and a flexible structure 211 forming the elasticity with the same advantages as those 109 and 111 of the first embodiment.

It is understood that the amplitude of the resonator 207 is therefore limited to the maximum clearances of the flexible structure 211 and in particular of the geometry of the beams 226, bases 220 and blades 222, 224. This limitation of the clearances nevertheless renders tripping of the resonator 207 inherently impossible, which solves by construction the main problem that customarily puts detent escapement systems at a disadvantage.

As can be seen in FIGS. 5 and 6, the inertia member 209 is also fitted with a release element 213 similar to that 113 of the first embodiment. More specifically, in the manner of a usual detent escapement, the second embodiment comprises a release element 213 that allows, in one of the directions of oscillation, a mute vibration, i.e. the release element 213 comes into contact with the detent 217, but does not displace the detent 217. Thus, according to the second embodiment the release element 213 preferably comprises a flexible body 231 and a releasing stop 233 arranged to force the single-piece detent 217 to shift in a single direction of the oscillations of the resonator 207.

As illustrated more clearly in FIG. 6, the oscillator 201 additionally comprises a detent escapement 215 comprising a single-piece detent 217 fixed to the pivoting staff 203. The detent 217 comprises a single flexible blade 216 and a stop member 218 arranged to elastically lock the pivoting staff 203 in relation to a concentric escapement toothing 219 in relation to the pivoting staff 203.

As in the case of the first embodiment, the release element 213 of the second embodiment is arranged to force the flexible blade 216 to bend in order to elastically unlock the stop member 218 in relation to the concentric escapement toothing 219, by the movement of the inertia member 209, so that the pivoting staff 203 counts each oscillation of the resonator 207 while transmitting to it the energy capable of maintaining it.

This is made possible because the single-piece detent 217 comprises a detent stop 237 fixed to the flexible blade 216, which is arranged to come into contact with the release element 213 at each vibration of the resonator 207. As evident from FIG. 6, the detent stop 237 forms a cam which, when it comes into contact with the discharging pallet 232, forces by the action of the releasing stop 233 the flexible blade 216 to move away from the escapement toothing 219 to release the pivoting staff 203. The pivoting staff 203 under the force of the mechanical energy source will perform a rotation, which corresponds to the angle between two teeth of the escapement toothing 219 and at the same time relaunches the resonator 207 by the transmission of its movement directly by the beams 226 via the anchoring devices 221.

In contrast, in the reverse vibration of the resonator 207 it is observed that the detent stop 237 forms a cam which, when it comes into contact with the discharging pallet 232, by the lack of action of the releasing stop 233 in the reverse direction, forces the discharging pallet 232 to move elastically away, then once having escaped the detent stop 237, to come back elastically along the releasing stop 233.

Advantageously, according to the second embodiment of the invention it is thus understood that the oscillator 201 comprises very few parts to be assembled, since the majority of them are formed in a single piece, which enables the parts to be referenced more easily in relation to one another. In fact, by way of example, the single-piece resonator 207 and the single-piece detent 217 could be formed in two fixed single plates forming at least two functional levels of the pivot axis 203. This could be achieved, for example, by silicon plates that are fixed in place, then etched, or by electroforming a metal part at several levels.

Moreover, because of the use of the flexible structure 211, the resonator 207 has a very low thickness and inherently causes tripping to be eliminated. Moreover, the oscillator 201 according to the invention advantageously allows the resonator 207 to have an impulse by a direct torque rather than a force by contact, as in the case of a usual detent escapement.

In addition, the operation leads to advantages usually associated with much more complex tourbillon-type oscillators, as already explained in the first embodiment. Consequently, in the manner of a tourbillon, but without its adjustment complexity, the pivoting staff 203 of the second embodiment eliminates the working variations of the oscillator 201 in vertical positions by turning the resonator 207 at the same time as the detent 217.

Finally, as in the first embodiment, the pivoting staff 203 can comprise, either directly or by means of an elastic energy accumulator, a pinion arranged to mesh with a going train in order to be connected to the mechanical energy source and to display the time. Thus, whatever the choice of energy transmission, it is clear that the force of the going train, and possibly that of the elastic energy accumulator, must be dimensioned so as not to drive the operation of the detent 217 in any other way than by the release element 213.

Figure 7:
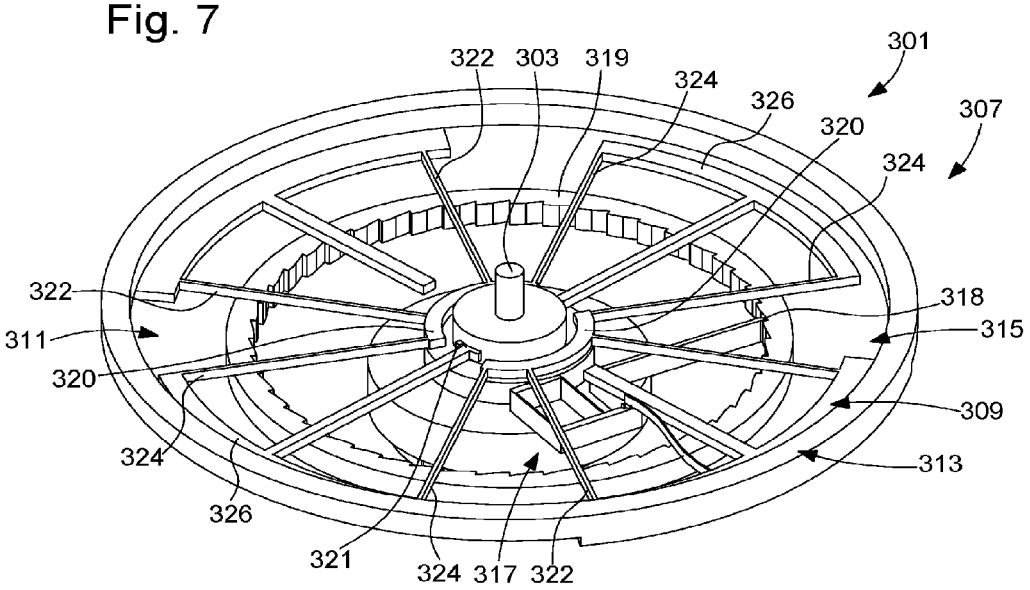
FIG. 7 is a perspective view of a third embodiment of an oscillator according to the invention.
Figure 8:
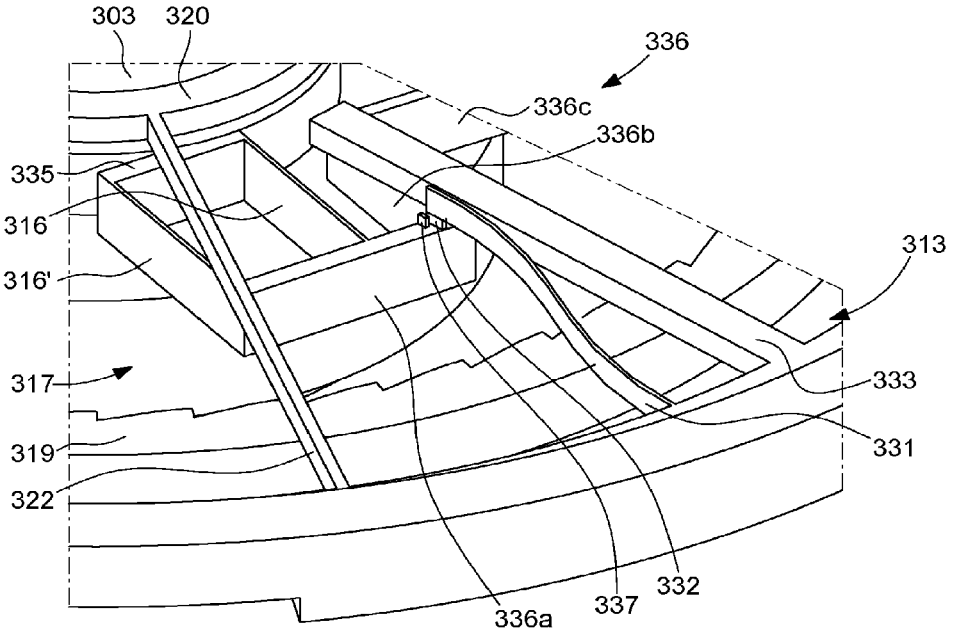
FIG. 8 is an enlarged view of FIG. 7.

A third embodiment of an oscillator 301 according to the invention is presented in FIGS. 7 and 8. Thus, the oscillator 301 comprises a pivoting staff 301 and a single-piece inertia-elasticity resonator 307 similar to those 103, 203, 107, 207 of the first and second embodiments. This resonator 307 thus includes a member 309 forming the inertia and a flexible structure 311 forming the elasticity with the same advantages as those 109, 209 and 111 211 of the first and second embodiments.

It is understood that the amplitude of the resonator 307 is thus limited to the maximum clearances of the flexible structure 311, and in particular of the geometry of the beams 326, bases 320 and blades 322, 324. This limitation of the clearances nevertheless renders tripping of the resonator 307 inherently impossible, which solves by construction the main problem that customarily puts detent escapement systems at a disadvantage.

As evident from FIGS. 7 and 8, the inertia member 309 is also fitted with a release element 313 similar to that 113, 213 of the first and second embodiments. More precisely, in the manner of a usual detent escapement, the third embodiment comprises a release element 313 that allows, in one of the directions of oscillation, a mute vibration, i.e. the release element 313 comes into contact with the detent 317, but does not displace the detent 317. Thus, according to the third embodiment the release element 313 preferably comprises a flexible body 331 and a releasing stop 333 arranged to force the single-piece detent 317 to shift in a single direction of the oscillations of the resonator 307.

As illustrated more clearly in FIG. 8, the oscillator 301 additionally comprises a detent escapement 315 comprising a single-piece detent 317 fixed to the pivoting staff 303. The detent 317 comprises at least one flexible blade 316, 316' and a stop member 318 arranged to elastically lock the pivoting staff 303 in relation to a concentric escapement toothing 319 in relation to the pivoting staff 303.

As in the case of the first and second embodiments, the release element 313 of the third embodiment is arranged to force the at least one flexible blade 316, 316' to bend in order to elastically unlock the stop member 318 in relation to the concentric escapement toothing 319, by the movement of the inertia member 309, so that the pivoting staff 303 counts each oscillation of the resonator 307 while transmitting to it the energy able to maintain it.

In the third embodiment illustrated in FIGS. 7 and 8, the single-piece detent 317 comprises two parallel cross members 335, 336 and two parallel blades 316, 316'. As seen more clearly from FIG. 8, a first cross member 335 is connected at a first end to the pivoting staff 303, and at a second end perpendicularly to a first flexible blade316. Moreover, the second cross member 336 is connected at a first end to the stop member 318 (more clearly visible in FIG. 7) and at a second end perpendicularly to a second flexible blade 316'. Finally, the first 316 and second 316' flexible blades are respectively connected to the second 336 and first 335 cross members.

As evident from FIGS. 7 and 8, the second cross member 336 preferably has three rectilinear sections. The first section 336*a* connects the two flexible blades 316, 316' and is attached substantially perpendicularly, in a trigonometric sense, to the second section 336*b*, which runs alongside the first flexible blade 316, which is itself attached substantially perpendicularly in the reverse direction to the third section 336*c*, which carries the stop member 318. It is thus understood that the sections 336*a* and 336*c* are substantially parallel.

Thus, the cross members 335, 336 visible in resting position in FIGS. 7 and 8 are able with the assistance of the elastic bending of the flexible blades 316, 316' to be displaced in relation to one another. More precisely, the release element 313 is arranged to force the flexible blades 316, 316' to bend in order to elastically unlock the stop member 318 in relation to the concentric escapement toothing 319, by the movement of the inertia member 309, so that the pivoting staff 303 counts each oscillation of the resonator 307 while transmitting to it the energy able to maintain it.

This is made possible because the single-piece detent 317 comprises a detent stop 337 fixed to the second cross member 336 at the level of the first section 336*a*, which is arranged to come into contact with the release element 313 at each vibration of the resonator 307. As evident from FIG. 8, the detent stop 337 forms a cam which, when it comes into contact with the discharging pallet 332, forces by the action of the releasing stop 333 the cross member 336, and in particular its third section 336*c*, to move away from the escapement toothing 319 to release the pivoting staff 303. The pivoting staff 303 under the force of the mechanical energy source will perform a rotation, which corresponds to the angle between two teeth of the escapement toothing 319 and at the same time relaunches the resonator 307 by the transmission of its movement directly by the beams 326 via the anchoring devices 321.

In contrast, in the reverse vibration of the resonator 307 it is observed that the detent stop 337 forms a cam which, when it comes into contact with the discharging pallet 332, by the lack of action of the releasing stop 333 in the reverse direction, forces the discharging pallet 332 to move elastically away, then once having escaped the detent stop 337, to come back elastically along the releasing stop 333.

Advantageously, according to the third embodiment of the invention it is thus understood that the oscillator 301 comprises very few parts to be assembled, since the majority of them are formed in a single piece, which enables the parts to be referenced more easily in relation to one another. In fact, by way of example, the single-piece resonator 307 and the single-piece detent 317 could be formed in two fixed single plates forming at least two functional levels of the pivot axis 303. This could be achieved, for example, by silicon plates that are fixed in place, then etched, or by electroforming a metal part at several levels.

Moreover, because of the use of the flexible structure 311, the resonator 307 has a very low thickness and inherently causes tripping to be eliminated. Moreover, the oscillator 301 according to the invention advantageously allows the resonator 307 to have an impulse by a direct torque rather than a force by contact, as in the case of a usual detent escapement.

In addition, the operation leads to advantages usually associated with much more complex tourbillon-type oscillators, as already explained in the first embodiment. Consequently, in the manner of a tourbillon, but without its adjustment complexity, the pivoting staff 303 of the third embodiment eliminates the working variations of the oscillator 301 in vertical positions by turning the resonator 307 at the same time as the detent 317.

Finally, as in the case of the first and second embodiments, the pivoting staff 303 can comprise, either directly or by means of an elastic energy accumulator, a pinion arranged to mesh with a going train in order to be connected to the mechanical energy source and to display the time. Thus, whatever the choice of energy transmission chosen in the third embodiment, it is clear that the force of the going train, and possibly that of the elastic energy accumulator, must be dimensioned so as not to drive the operation of the detent 317 in any other way than by the release element 313.

Figure 9:
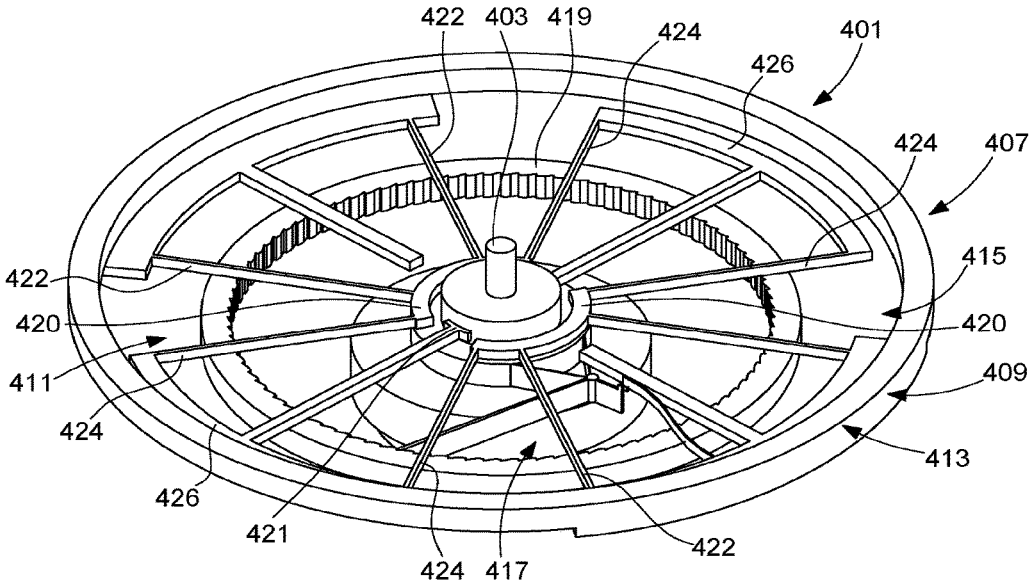
FIG. 9 is a perspective view of a fourth embodiment of an oscillator according to the invention.
Figure 10:
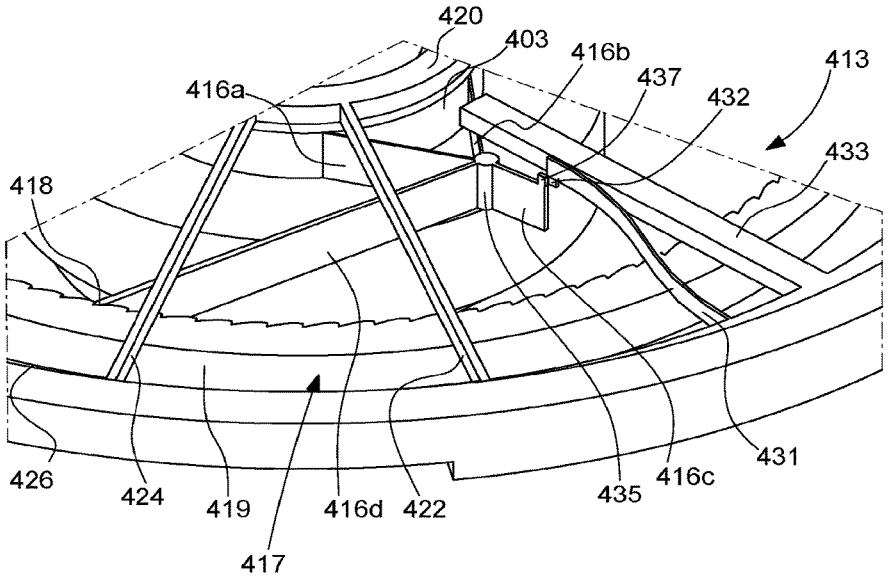
FIG. 10 is an enlarged view of FIG. 9.

A fourth embodiment of an oscillator 401 according to the invention is presented in FIGS. 9 and 10. Thus, the oscillator 401 comprises a pivoting staff 403 and a single-piece inertia-elasticity resonator 407 similar to those 103, 203, 303, 107, 207, 307 of the first three embodiments. This resonator 407 thus includes a member 409 forming the inertia and a flexible structure 411 forming the elasticity with the same advantages as those 109, 209, 309 and 111, 211, 311 of the first three embodiments.

It is understood that the amplitude of the resonator 407 is thus limited to the maximum clearances of the flexible structure 411, and in particular of the geometry of the beams 426, bases 420 and blades 422, 424. This limitation of the clearances nevertheless renders tripping of the resonator 407 inherently impossible, which solves by construction the main problem that customarily puts detent escapement systems at a disadvantage.

As evident from FIGS. 9 and 10, the inertia member 409 is also fitted with a release element 413 similar to that 113, 213, 313 of the first three embodiments. More precisely, in the manner of a usual detent escapement, the fourth embodiment comprises a release element 413 that allows, in one of the directions of oscillation, a mute vibration, i.e. the release element 413 comes into contact with the detent 417, but does not displace the detent 417. Thus, according to the fourth embodiment the release element 413 preferably comprises a flexible body 431 and a releasing stop 433 arranged to force the single-piece detent 417 to shift in a single direction of the oscillations of the resonator 407.

As illustrated more clearly in FIG. 10, the oscillator 401 additionally comprises a detent escapement 415 comprising a single-piece detent 417 fixed to the pivoting staff 403. The detent 417 comprises at least one flexible blade 416*a*, 416*b*, 416*c*, 416*d* and a stop member 418 arranged to elastically lock the pivoting staff 403 in relation to a concentric escapement toothing 419 in relation to the pivoting staff 403.

As in the case of the first three embodiments, the release element 413 of the fourth embodiment is arranged to force the at least one flexible blade 416*a*, 416*b*, 416*c*, 416*d* to bend in order to elastically unlock the stop member 418 in relation to the concentric escapement toothing 419, by the movement of the inertia member 409, so that the pivoting staff 403 counts each oscillation of the resonator 407 while transmitting to it the energy able to maintain it.

In the fourth embodiment illustrated in FIGS. 9 and 10, the single-piece detent 417 comprises first and second non-parallel flexible blades 416*a*, 416*b* that each connect the pivoting staff 403 to a substantially cylindrical attachment 435. The attachment 435 is additionally connected to a third flexible blade 416*d*, the free end of which includes the stop member 418. Finally, the attachment 435 also comprises a fourth flexible blade 416*c* comprising a detent stop 437, which is arranged to come into contact with the release element 413 at each vibration of the resonator 407. As evident from FIG. 10, the third and fourth blades 416*d*, 416*c* are preferably substantially perpendicular.

Thus, the flexible blades 416*a*, 416*b*, 416*c*, 416*d* visible in resting position in FIGS. 9 and 10 are able with the assistance of their elastic bending to be displaced in relation to one another. More precisely, the release element 413 is arranged to force the flexible blades 416*a*, 416*b*, 416*c*, 416*d* to bend in order to elastically unlock the stop member 418 in relation to the concentric escapement toothing 419, by the movement of the inertia member 409, so that the pivoting staff 403 counts each oscillation of the resonator 407 while transmitting to it the energy able to maintain it. According to the invention blades 416*c* and 416*d* are preferably less flexible than blades 416*a* and 416*b* in order to obtain the rotation movement around the attachment 435 for the purpose of releasing the member 418 of the escapement toothing 419.

This is made possible because the single-piece detent 417 comprises a detent stop 437 fixed to the fourth flexible blade 416*c*, which is arranged to come into contact with the release element 413 at each vibration of the resonator 407. As evident from FIG. 10, the detent stop 437 forms a cam which, when it comes into contact with the discharging pallet 432, forces by the action of the releasing stop 433 the third flexible blade 436*d* to move away from the escapement toothing 419 to release the pivoting staff 403. The pivoting staff 403 under the force of the mechanical energy source will perform a rotation, which corresponds to the angle between two teeth of the escapement toothing 419 and at the same time relaunches the resonator 407 by the transmission of its movement directly by the beams 426 via the anchoring devices 421.

In contrast, in the reverse vibration of the resonator 407 it is observed that the detent stop 437 forms a cam which, when it comes into contact with the discharging pallet 432, by the lack of action of the releasing stop 433 in the reverse direction, forces the discharging pallet 432 to move elastically away, then once having escaped the detent stop 437, to come back elastically along the releasing stop 433.

Advantageously, according to the fourth embodiment of the invention it is thus understood that the oscillator 401 comprises very few parts to be assembled, since the majority of them are formed in a single piece, which enables the parts to be referenced more easily in relation to one another. In fact, by way of example, the single-piece resonator 407 and the single-piece detent 417 could be formed in two fixed single plates forming at least two functional levels of the pivot axis 403. This could be achieved, for example, by silicon plates that are fixed in place, then etched, or by electroforming a metal part at several levels.

Moreover, because of the use of the flexible structure 411, the resonator 407 has a very low thickness and inherently causes tripping to be eliminated. Moreover, the oscillator 401 according to the invention advantageously allows the resonator 407 to have an impulse by a direct torque rather than a force by contact, as in the case of a usual detent escapement.

In addition, the operation leads to advantages usually associated with much more complex tourbillon-type oscillators, as already explained in the first embodiment. Consequently, in the manner of a tourbillon, but without its adjustment complexity, the pivoting staff 403 of the fourth embodiment eliminates the working variations of the oscillator 401 in vertical positions by turning the resonator 407 at the same time as the detent 417.

Finally, as in the first three embodiments, the pivoting staff 403 can comprise, either directly or by means of an elastic energy accumulator, a pinion arranged to mesh with a going train in order to be connected to the mechanical energy source and to display the time. Thus, whatever the choice of energy transmission, it is clear that the force of the going train, and possibly that of the elastic energy accumulator, must be dimensioned so as not to drive the operation of the detent 417 in any other way than by the release element 413.

Figure 11:
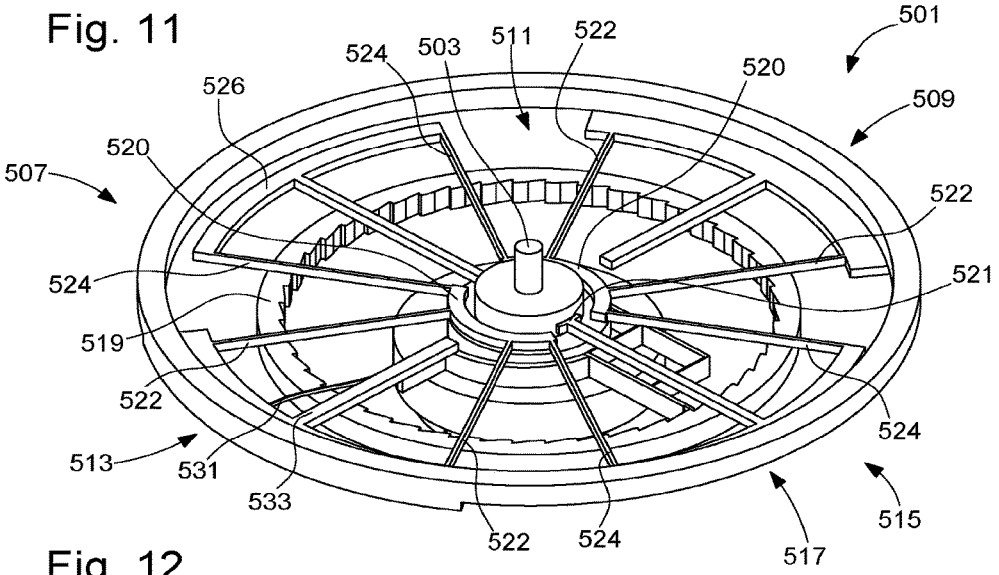
FIG. 11 is a perspective view of a fifth embodiment of an oscillator according to the invention.
Figure 12:
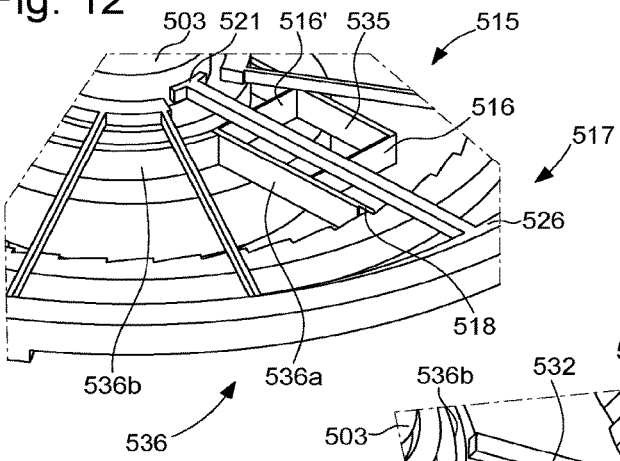
FIG. 12 is a first enlarged view of FIG. 11.
Figure 13:
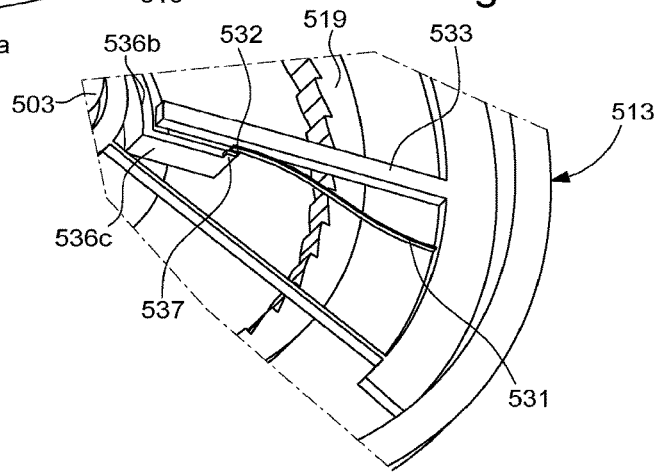
FIG. 13 is a second enlarged view of FIG. 11.

A fifth embodiment of an oscillator 501 according to the invention is presented in FIGS. 11 to 13. Thus, the oscillator 501 comprises a pivoting staff 503 and a single-piece inertia-elasticity resonator 507 similar to those 103, 203, 303, 403, 107, 207, 307, 407 of the first four embodiments. This resonator 507 thus includes a member 509 forming the inertia and a flexible structure 511 forming the elasticity with the same advantages as those 109, 209, 309, 409 and 111, 211, 311, 411 of the first four embodiments.

It is understood that the amplitude of the resonator 507 is thus limited to the maximum clearances of the flexible structure 511, and in particular of the geometry of the beams 526, bases 520 and blades 522, 524. This limitation of the clearances nevertheless renders tripping of the resonator 507 inherently impossible, which solves by construction the main problem that customarily puts detent escapement systems at a disadvantage.

As evident from FIGS. 11 and 13, the inertia member 509 is also fitted with a release element 513 similar to that 113, 213, 313, 413 of the first four embodiments. More precisely, in the manner of a usual detent escapement, the fifth embodiment comprises a release element 513 that allows, in one of the directions of oscillation, a mute vibration, i.e. the release element 513 comes into contact with the detent 517, but does not displace the detent 517. Thus, according to the fifth embodiment the release element 513 preferably comprises a flexible body 531 and a releasing stop 533 arranged to force the single-piece detent 517 to shift in a single direction of the oscillations of the resonator 507.

As illustrated more clearly in FIGS. 12 and 13, the oscillator 501 additionally comprises a detent escapement 515 comprising a single-piece detent 517 fixed to the pivoting staff 503. The detent 517 comprises at least one flexible blade 516, 516' and a stop member 518 arranged to elastically lock the pivoting staff 503 in relation to a concentric escapement toothing 519 in relation to the pivoting staff 503.

It is thus understood that the toothing 519 is fixed in relation to the pivoting staff 503. In fact, the pivoting staff 503 under the force of the mechanical energy source will perform a rotation, which corresponds to the angle between two teeth of the escapement toothing 519, i.e. each time the stop member 518 of the detent 517 will permit its displacement from one tooth to another.

In the fifth embodiment illustrated in FIGS. 11 to 13, the single-piece detent 517 comprises two parallel cross members 535, 536 and two parallel blades 516, 516'. As seen more clearly from FIG. 12, a first cross member 535 is connected at a first end to the pivoting staff 503, and at a second end perpendicularly to a first flexible blade 516. Moreover, the second cross member 536 is connected at a first end to the stop member 518 and at a second end perpendicularly to a second flexible blade 516'. Finally, the first 516 and second 516' flexible blades are respectively connected to the second 536 and first 535 cross members.

As evident from FIGS. 11 to 13, the second cross member 536 preferably comprises three sections. The first rectilinear section 536*a* connects the two flexible blades 516, 516', bears the stop member 318 at one end and at the opposite end is attached substantially perpendicularly in the reverse direction to the second curved section 536*b* in the form of a quadrant, which is itself attached substantially perpendicularly in the trigonometric sense to the third rectilinear section 536*c*, which carries a detent stop 537. It is thus understood that the sections 536*a* and 536*c* are substantially perpendicular.

It is thus understood that the cross members 535, 536 visible in resting position in FIGS. 11 to 13 are able with the assistance of the elastic bending of the flexible blades 516, 516' to be displaced in relation to one another. More precisely, the release element 513 is arranged to force the flexible blades 516, 516' to bend in order to elastically unlock the stop member 518 in relation to the concentric escapement toothing 519, by the movement of the inertia member 509, so that the pivoting staff 503 counts each oscillation of the resonator 507 while transmitting to it the energy able to maintain it.

This is made possible because the single-piece detent 517 comprises the detent stop 537 fixed to the second cross member 536, which is arranged to come into contact with the release element 513 at each vibration of the resonator 507. As evident from FIG. 13, the detent stop 537 forms a cam which, when it comes into contact with the discharging pallet 532, forces by the action of the releasing stop 533 the first rectilinear section 536*a* to move away from the escapement toothing 519 to release the pivoting staff 503. The pivoting staff 503 under the force of the mechanical energy source will perform a rotation, which corresponds to the angle between two teeth of the escapement toothing 519 and at the same time relaunches the resonator 507 by the transmission of its movement directly by the beams 526 via the anchoring devices 521.

In contrast, in the reverse vibration of the resonator 507 it is observed that the detent stop 537 forms a cam which, when it comes into contact with the discharging pallet 532, by the lack of action of the releasing stop 533 in the reverse direction, forces the discharging pallet 532 to move elastically away, then once having escaped the detent stop 537, to come back elastically along the releasing stop 533.

Advantageously, according to the fifth embodiment of the invention it is thus understood that the oscillator 501 comprises very few parts to be assembled, since the majority of them are formed in a single piece, which enables the parts to be referenced more easily in relation to one another. In fact, by way of example, the single-piece resonator 507 and the single-piece detent 517 could be formed in two fixed single plates forming at least two functional levels of the pivot axis 503. This could be achieved, for example, by silicon plates that are fixed in place, then etched, or by electroforming a metal part at several levels.

Moreover, because of the use of the flexible structure 511, the resonator 507 has a very low thickness and inherently causes tripping to be eliminated. Moreover, the oscillator 501 according to the invention advantageously allows the resonator 507 to have an impulse by a direct torque rather than a force by contact, as in the case of a usual detent escapement.

In addition, the operation leads to advantages usually associated with much more complex tourbillon-type oscillators, as already explained in the first embodiment. Consequently, in the manner of a tourbillon, but without its adjustment complexity, the pivoting staff 503 of the fifth embodiment eliminates the working variations of the oscillator 501 in vertical positions by turning the resonator 507 at the same time as the detent 517.

Finally, as in the case of the first four embodiments, the pivoting staff 503 can comprise, either directly or by means of an elastic energy accumulator, a pinion arranged to mesh with a going train in order to be connected to the mechanical energy source and to display the time. Thus, whatever the choice of energy transmission chosen in the third embodiment, it is clear that the force of the going train, and possibly that of the elastic energy accumulator, must be dimensioned so as not to drive the operation of the detent 517 in any other way than by the release element 513.

Whatever the embodiment, it is noted that the pivoting staff 3, 103, 203, 303, 403, 503 counts each oscillation of the resonator 7, 107, 207, 307, 407, 507. This means that, depending on the construction of the resonator 7, 107, 207, 307, 407, 507, each oscillation is associated with a predetermined adjusted time. It is thus understood that a predetermined period specifically for visualising the time that passes on whatever type of timepiece is associated with each movement of the pivoting staff 3, 103, 203, 303, 403, 503. Thus, depending on the gear reductions of the going train, it is possible to display time information such as e.g. seconds, minutes, hours or a calendar value, either directly or indirectly by means of wheels of the going train.

Whatever the embodiment, with the mechanical energy source sufficiently charged, the manual unlocking device acting on the stop member 18, 118, 218, 318, 418, 518 can be made necessary for the user in order to start up the oscillator 1, 101, 201, 301, 401, 501. In fact, depending on the configuration of the oscillator 1, 101, 201, 301, 401, 501, it cannot be excluded that a movement caused by the user enabling displacement of the inertia member 9, 109, 209, 309, 409, 509 is not sufficient for the release element 113, 213, 313, 413, 513 to actuate the detent 17, 117, 217, 317, 417, 517.

Thus, as an absolutely non-restrictive example, such a manual unlocking device could be in the form of a crown or a push piece on the centrepart of the timepiece and control a catch to cause a tooth of the escapement toothing 19, 119, 219, 319, 419, 519 to pass to the stop member 18, 118, 218, 318, 418, 518 in order to supply the energy necessary to start up the oscillator 1, 101, 201, 301, 401, 501 to the resonator 7, 107, 207, 307, 407, 507.

Naturally, the present invention is not limited to the illustrated example, but also permits different variants and modifications that will occur to the person skilled in the art. In particular, depending on the desired application, the resonator 7, 107, 207, 307, 407, 507 and/or the detent 17, 117, 217, 317, 417, 517 can be modified, in particular with respect to their geometry (inertia member, detent) or their flexible structures.

Moreover, the embodiments described above can be combined with one another without departing from the framework of the invention. It is also possible, as an alternative to using the ring 127, to connect the releasing stops 133, 233, 333, 433, 533 of the release element 113, 213, 313, 413, 513 in order to couple the two sectors 125 of the inertia member 109, 209, 309, 409, 509 such as, for example, by twisting the pivoting staff 3, 103, 203, 303, 403, 503 laterally and/or vertically or passing through a pierced area of the pivoting staff 3, 103, 203, 303, 403, 503. It could also be possible to connect the two sectors 125 by a device other than the ring 127.

In addition, non-release devices could be added such as a locking arm or counter-inertial devices to lock the detent 17, 117, 217, 317, 417, 517 when release is not desired, i.e. when the detent 17, 117, 217, 317, 417, 517 will be displaced in a different manner than by the discharging pallet 132, 232, 332, 432, 532 such as e.g. following a shock suffered by the oscillator 1, 101, 201, 301, 401, 501.

Finally, damping devices can cooperate with the oscillator 1, 101, 201, 301, 401, 501, as with the staff 3, 103, 203, 303, 403, 503 in particular in order to render it less sensitive to shocks.

What is claimed is:

1. An oscillator comprising:

a pivoting staff connected to a mechanical energy source, an inertia-elasticity resonator in one piece comprising a member forming the inertia fitted with a release element and a flexible structure forming the elasticity, which is mounted between the pivoting staff and the member forming the inertia, a detent escapement comprising a single-piece detent fixed to the pivoting staff, which comprises at least one flexible blade and a stop member arranged to elastically lock the pivoting staff in relation to a concentric escapement toothing, wherein the release element is arranged to elastically unlock the stop member in relation to the concentric escapement toothing, by movement of the member forming the inertia, so that the pivoting staff counts each oscillation of the resonator while transmitting to the resonator the energy able to maintain the resonator.

2. The oscillator according to claim 1, wherein the flexible structure comprises at least one anchoring fixed to the pivoting staff and the flexible structure is arranged to form a virtual pivot axis of the resonator coincident with a center of rotation of the pivoting staff.

3. The oscillator according to claim 2, wherein the flexible structure comprises at least one base respectively connecting the member forming the inertia and the at least one anchoring by at least one flexible blade.

4. The oscillator according to claim 1, wherein the member forming the inertia is formed by two sectors, wherein an inside surface of one of the sectors comprises the release element.

5. The oscillator according to claim 4, wherein the release element comprises a flexible body, a free end of which is fitted with a discharging pallet, a displacement of which is controlled by the member forming the inertia, and which is arranged to come into contact with the single-piece detent at each vibration of the resonator.

6. The oscillator according to claim 5, wherein the release element additionally comprises a releasing stop arranged to force the flexible body to displace the single-piece detent in a single direction of oscillations of the resonator.

7. The oscillator according to claim 1, wherein the single-piece detent comprises a single flexible blade, a detent stop being fixed to the single flexible blade and arranged to come into contact with the release element on each vibration of the resonator.

8. The oscillator according to claim 1, wherein the single-piece detent comprises two parallel cross members, wherein a first cross member is connected at a first end to the pivoting staff, and at a second end perpendicularly to a first flexible blade, a second cross member is connected at a first end to the stop member and at a second end perpendicularly to a second flexible blade, wherein the first and second flexible blades are parallel and respectively connected to the second and first cross members.

9. The oscillator according to claim 8, wherein the single-piece detent comprises a detent stop fixed to the second cross member, which is arranged to come into contact with the release element on each vibration of the resonator.

10. The oscillator according to claim 1, wherein the single-piece detent comprises two parallel cross members, wherein a first cross member is connected at a first end to the pivoting staff, and perpendicularly to a first flexible blade, a second cross member is connected at a first end to the stop member and at a second end perpendicularly to a second flexible blade, wherein the first and second flexible blades are parallel and respectively connected to the second and first cross members.

11. The oscillator according to claim 1, wherein the single-piece detent comprises first and second flexible and non-parallel blades, each connecting the pivoting staff to an attachment, wherein the attachment is additionally connected to a third flexible blade, a free end of which includes the stop member and to a fourth flexible blade comprising a detent stop, which is arranged to come into contact with the release element on each vibration of the resonator.

12. The oscillator according to claim 1, wherein the pivoting staff comprises a pinion arranged to mesh with a going train in order to be connected to the mechanical energy source and to display time.

13. The oscillator according to claim 12, wherein the pinion is mounted to be idle on the pivoting staff by means of an elastic energy accumulator in order to supply sufficient energy to maintain the resonator during an impulse period.

14. The oscillator according to claim 1, wherein the single-piece resonator and the single-piece detent are formed in two fixed single plates forming two functional levels of a pivot axis.

* * * * *